US008625826B2

(12) United States Patent
Fischer

(10) Patent No.: US 8,625,826 B2
(45) Date of Patent: Jan. 7, 2014

(54) APPARATUS AND METHOD FOR BACKGROUND NOISE ESTIMATION WITH A BINAURAL HEARING DEVICE SUPPLY

(75) Inventor: Eghart Fischer, Schwabach (DE)

(73) Assignee: Siemens Medical Instruments Pte. Ltd., Singapore (SG)

( * ) Notice: Subject to any disclaimer, the term of this patent is extended or adjusted under 35 U.S.C. 154(b) by 566 days.

(21) Appl. No.: 12/706,088

(22) Filed: Feb. 16, 2010

(65) Prior Publication Data

US 2010/0208921 A1 Aug. 19, 2010

(30) Foreign Application Priority Data

Feb. 16, 2009 (DE) ..... 10 2009 009 040

(51) Int. Cl.
*H04R 25/00* (2006.01)

(52) U.S. Cl.
USPC ..... 381/313; 381/92; 381/318; 381/94.1

(58) Field of Classification Search
USPC ..... 381/313, 318, 92, 23.1, 94.1
See application file for complete search history.

(56) References Cited

U.S. PATENT DOCUMENTS

| | | | |
|---|---|---|---|
| 7,369,669 | B2 | 5/2008 | Hagen et al. |
| 2005/0120377 | A1 | 6/2005 | Carlucci et al. |
| 2005/0183120 | A1 | 8/2005 | Jain et al. |
| 2006/0218601 | A1 | 9/2006 | Michel |
| 2006/0236358 | A1 | 10/2006 | Liu et al. |
| 2007/0127519 | A1 | 6/2007 | Hasek et al. |
| 2007/0201513 | A1 | 8/2007 | Anderson et al. |
| 2007/0223754 | A1* | 9/2007 | Roeck et al. ..... 381/313 |

FOREIGN PATENT DOCUMENTS

| | | | |
|---|---|---|---|
| EP | 1049031 | A2 | 11/2000 |
| EP | 1365628 | A2 | 11/2003 |
| WO | 2007061955 | A2 | 5/2007 |

OTHER PUBLICATIONS

European Search Report dated Jun. 9, 2010.
Hamacher, "Comparison of Advanced Monaural and Binaural Noise Reduction Algorithms for Hearing Aids", Siemens Audiology Group, 2002, pp. 1-4.

* cited by examiner

*Primary Examiner* — Davetta W Goins
*Assistant Examiner* — Amir Etesam
(74) *Attorney, Agent, or Firm* — Laurence A. Greenberg; Werner H. Stemer; Ralph E. Locher

(57) ABSTRACT

An apparatus and a method for background noise estimation use a first and a second hearing device for binaural supply of a hearing impaired person. In each case the hearing devices have a first and a second omnidirectional microphone and the two microphones of each hearing device are connected to each other electrically in order to form a first and/or a second monaural directional characteristic. The first and/or second microphone of the first hearing device is connected together wirelessly with the first and/or second microphone of the second hearing device to form a binaural directional characteristic. To estimate the background noise, the level of an output signal from the first and/or the second directional microphone having a monaural directional characteristic is combined with the level of an output signal from the directional microphone having a binaural directional characteristic. Background noise estimation is thereby enhanced in the case of binaural supply.

16 Claims, 4 Drawing Sheets

APPARATUS AND METHOD FOR BACKGROUND NOISE ESTIMATION WITH A BINAURAL HEARING DEVICE SUPPLY

CROSS-REFERENCE TO RELATED APPLICATION

This application claims the priority, under 35 U.S.C. §119, of German application DE 10 2009 009 040.1, filed Feb. 16, 2009; the prior application is herewith incorporated by reference in its entirety.

BACKGROUND OF THE INVENTION

Field of the Invention

The invention relates to an apparatus and a method for background noise estimation with a first and a second hearing device for a binaural supply of a hearing impaired person. In each case the hearing devices have a first and a second omnidirectional microphone and the two microphones of each hearing device are electrically connected to each other in order to form a first and a second directional microphone having a monaural directional characteristic.

Hearing devices are portable hearing apparatuses which are used to aid the hard-of-hearing. To accommodate the numerous individual requirements, different configurations of hearing devices such as behind-the-ear hearing devices (BTE), hearing devices with an external earpiece and in-the-ear hearing devices (ITE), e.g. concha hearing devices or channel hearing devices (CIC), are provided. The hearing devices configured by way of example are worn on the outer ear or in the auditory canal. Furthermore, bone conduction hearing devices, implantable or vibrotactile hearing devices are also available on the market. The damaged ear is herewith either stimulated mechanically or electrically.

Essential components of the hearing devices include in principal an input converter, an amplifier and an output converter. The input converter is generally a recording transducer, e.g. a microphone and/or an electromagnetic receiver, e.g. an induction coil. The output converter is mostly realized as an electroacoustic converter, e.g. a miniature loudspeaker, or as an electromechanical converter, e.g. a bone conduction receiver. The amplifier is usually integrated into a signal processing unit. The main configuration is shown in the example in FIG. 1 of a behind-the-ear hearing device 1. One or a number of microphones 3 for recording the ambient sound are incorporated in a hearing device housing 2 to be worn behind the ear. A signal processing unit 4, which is similarly integrated into the hearing device housing 1, processes the microphone signals and amplifies them. The output signal of the signal processing unit 4 is transmitted to a loudspeaker and/or earpiece 5, which outputs an acoustic signal. The sound is optionally transmitted to the ear drum of the device wearer via a sound tube, which is fixed with an otoplastic in the auditory canal. The power supply of the hearing device 1 and in particular of the signal processing unit 4 is supplied by a battery 6 which is likewise integrated into the hearing device housing 2.

With regard to the processing of digitally captured speech, for example by digital hearing devices, it is often desirable to suppress disruptive background noises without thereby affecting the useful signal (speech). There are known filtering methods suitable for this purpose which influence the short-term spectrum of the signal, such as the Wiener filter. These methods do however presuppose a precise estimation of the frequency-dependent power of the background noise to be suppressed from an input signal. If this estimation is imprecise, either an unsatisfactory background noise suppression is achieved, the desired signal is affected or additional artificially created noise signals, also referred to as "musical tones" or "musical noise", are produced. There are no methods for background noise estimation yet available which solve these problems completely and efficiently.

Hitherto it has basically been possible to estimate the background noise power by using two approaches. Both methods can be undertaken either over a wide bandwidth or preferably in a frequency range split up by means of a filter bank or short-time Fourier transform. The two methods are now described.

1. Speech Activity Detection:

Provided no speech activity is detected, the complete (time-variable) input signal power is regarded as background noise. If speech activity is detected, the background noise estimation is kept constant at the value estimated prior to the onset of the speech activity.

2. Noise Power Estimation During Speech Activity (So-called "Minimum Tracking Method"):

It is known that even during speech activity the speech signal power in individual frequency ranges is repeatedly briefly almost zero. If there is now an underlying mixture of speech and background noise changing comparatively slowly over time, then the minima of the spectral signal power considered over time correspond to the background noise power at these points in time. The noise signal power must lie between the established minima ("minimum tracking"). The background noise power is typically determined separately for different frequency ranges of the input signal. To this end, the input signal is first split up by a filter bank or a Fourier transform into individual frequency components. These components are then processed separately from one another.

In the method 1 described above, on the one hand reliable detection of speech activity represents a problem, and on the other hand it is not possible to track background noise which varies over time during simultaneous speech activity.

In the method 2 described above, there are fundamental contradictions to be resolved in the setting of the algorithm: if speech is present, the background noise estimation should only be adapted slowly in order not to classify speech components as background noise as a result of fast adaptation and affect the speech quality in this way. If there is no speech present, then the noise power estimation should follow the temporal fine structure of the input signal without any delay. This produces conflicting demands for the setting parameters of the method, such as for example smoothing time constants, window length for a minimum search or weighting factors, which hitherto have only been able to be resolved optimally on average. Moreover, this method is not capable of following fast changes in the noise signal.

The "cepstral smoothing" of the weighting of spectral filters promises a further possibility for speech enhancement and the suppression of "musical tones". In this situation, a recursive, temporary smoothing is essentially applied to higher cepstral coefficients, whereby those coefficients which represent the pitch information are excluded. This method is also effective in the case of non-stationary noises.

The methods for background noise estimation described in the introduction are described in detail in the subsequently published, non-prosecuted German patent application DE 10 2008 031 A1, corresponding to U.S. Pat. No. 7,209,568.

The introductory statements demonstrate that a reliable estimation of a noise signal is complex and elaborate. In particular, a precise estimation is frequently difficult in the case of hearing devices on account of the influence of the head of a hearing device wearer.

Directional microphones are also included among the methods for background noise suppression which have been established for years and demonstrably lead to enhanced speech intelligibility in listening situations in which the useful signal and the noise signals originate from different directions. In modern hearing devices the directivity is produced through differential processing of two or more adjacent microphones having an omnidirectional characteristic.

FIG. 2 shows a simplified block diagram of a directional microphone system of the first order having a first and a second microphone 3A, 3B spaced about 10 to 15 mm apart. As a result, an external delay of T2 occurs between the two microphones 3A, 3B for sound signals which come from the front, which corresponds to the spacing of the microphones 3A, 3B with respect to one another. The signal R2 from the second microphone 3B is delayed by the time T1 in a delay unit 7, inverted in an inverter 8 and added to the signal R1 from the first microphone 3A in an adder 9. The sum yields the directional microphone signal RA which can be delivered to an earpiece by way of a signal processing facility for example. The direction-dependent sensitivity results essentially from a subtraction of the second microphone signal R2 delayed by the time T2 from the first signal R1. Sound signals from the front V are thus, after suitable equalization, not attenuated whereas for example sound signals from the side S or from the rear are extinguished.

The structure and mode of operation of directional microphone systems for hearing devices are described for example in German patent DE 103 31 956 B3.

The reference by Hamacher, V.: titled "Comparison of Advanced Monaural and Binaural Noise Reduction Algorithms for Hearing Devices"; IEEE 2002, pp. IV-4008 to IV-4011 discloses a combination of monaural and binaural noise power estimation with regard to hearing devices, whereby the monaural noise power is considered only for frequencies below a particular frequency.

The reference by Schaub, A.: titled "Digitale Hörgeräte—Was steckt dahinter?" [Digital Hearing Devices—What's Behind Them?]; Median-Verlag Heidelberg 2005; ISBN 3-022766-86-2, pp. 89 to 97 discloses digital hearing devices which use directional microphones to adaptively suppress acoustic noise which comes from the side and from the rear.

SUMMARY OF THE INVENTION

It is accordingly an object of the invention to provide an apparatus and a method for background noise estimation with a binaural hearing device supply which overcome the above-mentioned disadvantages of the prior art methods and devices of this general type.

The invention claims an apparatus for background noise estimation with a first and a second hearing device for binaural supply of a hearing impaired person, whereby in each case the hearing devices have a first and a second omnidirectional microphone and the two microphones of each hearing device are electrically connected to each other in order to form a first and/or a second directional microphone having a monaural directional characteristic. The first and/or second microphone of the first hearing device is connected together wirelessly with the first and/or second microphone of the second hearing device in order to form a directional microphone having a binaural directional characteristic. In order to estimate the background noise, the level of an output signal from the first and/or the second directional microphone having a monaural directional characteristic is combined with the level of an output signal from the directional microphone having a binaural directional characteristic. This offers the advantage that background noise can be estimated better and robustly.

In a development of the invention, the first and/or second monaural directional characteristic can form a zero point in the direction of a useful sound source.

In a further embodiment, the first and/or second monaural directional characteristic can form a monaural anti-cardioid.

Advantageously, the binaural directional characteristic can form a zero point in the direction of the useful sound source.

Furthermore, the binaural directional characteristic can form a binaural figure of eight.

In addition, the estimation can be formed by forming the maxima of the levels of the output signals from the directional microphones.

In a development, the estimation can be formed by forming the sums of the levels of the output signals from the directional microphones.

The invention also claims a method for background noise estimation with a first and a second hearing device for binaural provision for a hearing impaired person, whereby in each case the hearing devices have a first and a second omnidirectional microphone and the two microphones of each hearing device are connected to each other electrically in order to form a first and/or a second monaural directional characteristic. The first or second microphone of the first hearing device is connected together wirelessly with the first or second microphone of the second hearing device in order to form a binaural directional characteristic. In order to estimate the background noise, the level of an output signal from the first and/or the second directional microphone having a monaural directional characteristic is combined with the level of an output signal from the directional microphone having a binaural directional characteristic. As a result the background noise estimation is optimized.

By preference, the first and/or second monaural directional characteristic can be formed with a zero point in the direction of a useful sound source.

In a development, the binaural directional characteristic can be formed with a zero point in the direction of the useful sound source.

In a further embodiment, the estimation can be formed by forming the maxima of the levels of the output signals from the directional microphones.

Furthermore, the estimation can be formed by forming the sums of the levels of the output signals from the directional microphones.

Other features which are considered as characteristic for the invention are set forth in the appended claims.

Although the invention is illustrated and described herein as embodied in an apparatus and a method for background noise estimation with a binaural hearing device supply, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DETAILED DESCRIPTION OF THE INVENTION

Figure 1:
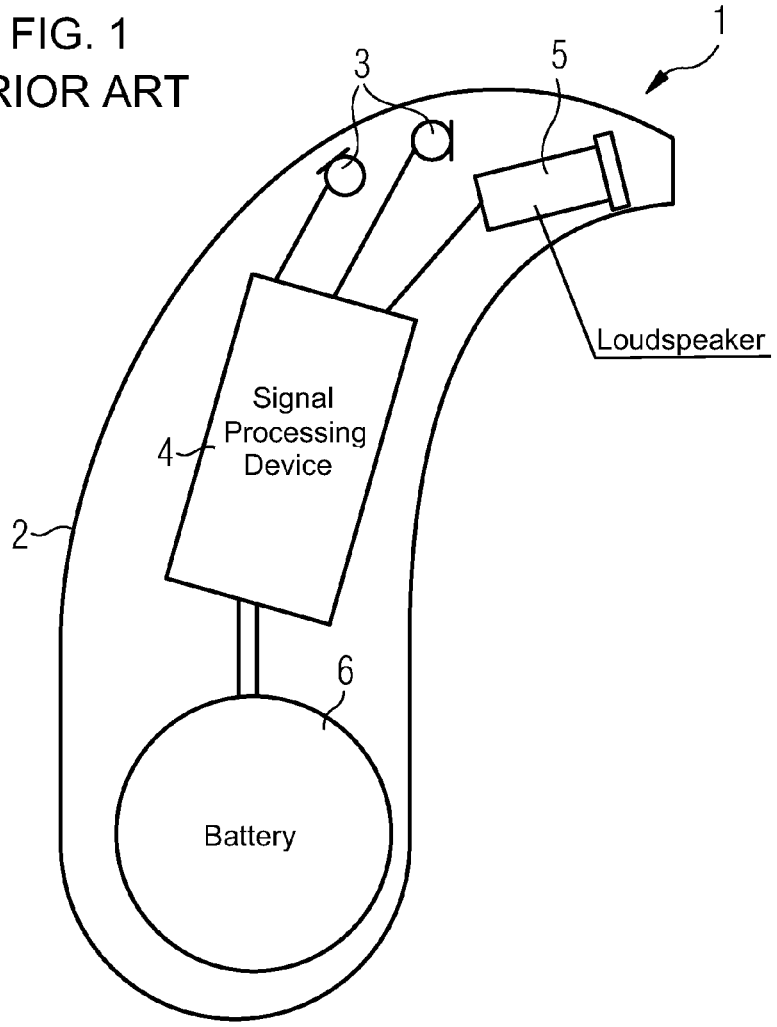
FIG. 1 PRIOR ART
FIG. 1 is an illustration of a behind-the-ear hearing device in accordance with the prior art.
Figure 2:
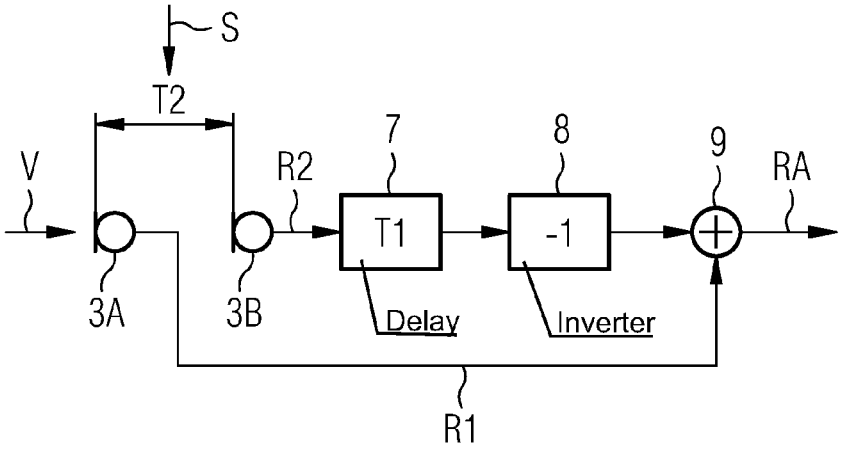
FIG. 2 PRIOR ART
FIG. 2 is a block diagram of a directional microphone in accordance with the prior art.
Figure 3:
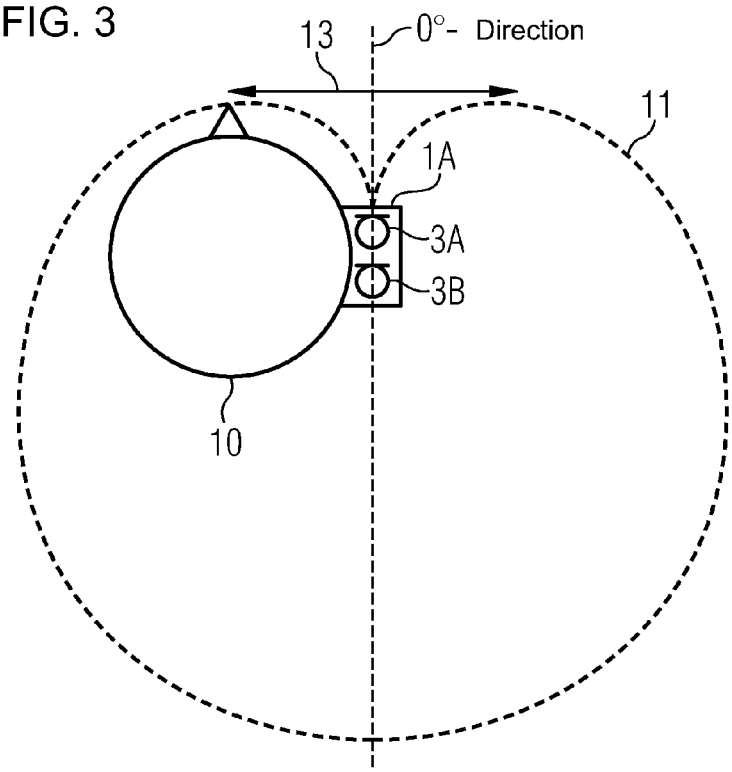
FIG. 3 is an illustration of a monaural microphone arrangement having an anti-cardioid shaped directional characteristic.

Referring now to the figures of the drawing in detail and first, particularly, to FIG. 3 thereof, there is shown a sectional view through a head 10 of a hearing device wearer with a first hearing device 1A. The section is taken parallel to a floor surface at the height of the first hearing device 1A. The first hearing device 1A contains a first and a second microphone 3A, 3B. The two microphones 3A, 3B are located close to one another and are connected to each other electrically in such a manner that they form a spatial directional characteristic in the shape of an anti-cardioid 11. Around a 0° direction, from which a useful signal comes, the directional characteristic exhibits an area 13 of strong attenuation. An estimation of acoustic noise is possible with this monaural directional characteristic 11.

The monaural anti-cardioid exhibits a relatively large aperture angle around the 0° direction. In other words, a type of "cone" is formed as the directional characteristic around the 0° direction, in which the sensitivity of the microphone characteristic increases successively from the inside outwards. A sharp spatial separation of sources around the 0° direction, for example in the range of 10-20°, cannot therefore be implemented. A reliable, robust "front/back" differentiation is however possible.

Figure 4:
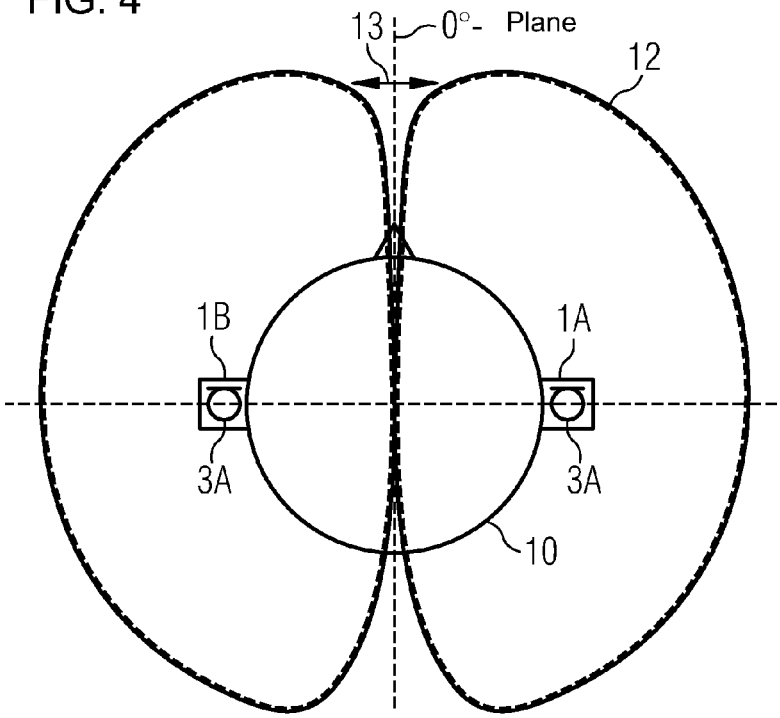
FIG. 4 is an illustration of a binaural microphone arrangement having a figure of eight shaped directional characteristic.

FIG. 4 shows a sectional view through the head 10 of a hearing device wearer with a first hearing device 1A and a second hearing device 1B for binaural supply. The section is taken parallel to a floor surface at the height of the two hearing devices 1A, 1B. The first and the second hearing device 1A, 1B each include a first microphone 3A. The first microphone 3A of the first hearing device 1A is connected together wirelessly with the first microphone 3A of the second hearing device 1B in order to form a directional microphone having a binaural directional characteristic 12. For example, by performing a simple subtraction on the microphone signals from the two microphones 3A a spatial directional characteristic 12 is produced, which corresponds to a "figure of eight", which lies in the direction of the axis connecting the two microphones 3A and ideally exhibits an area 13 with sensitivity zero in the 0° plane.

The binaural figure of eight 12 has the major disadvantage that while the sensitivity in the 0° direction is theoretically zero, it is however not only in the horizontal 0° direction but in the entire vertical 0° plane around the head 10. In other words, sources which are located for example directly above or behind the head 10 are attenuated just like sources from the 0° direction. These sources are thus added implicitly to a useful signal. The relatively narrow aperture angle in the 0° plane is however advantageous.

According to the invention, the aforementioned directional characteristics 11, 12 are combined for background noise estimation such that the advantages are utilized and the disadvantages are compensated for.

Figure 5:
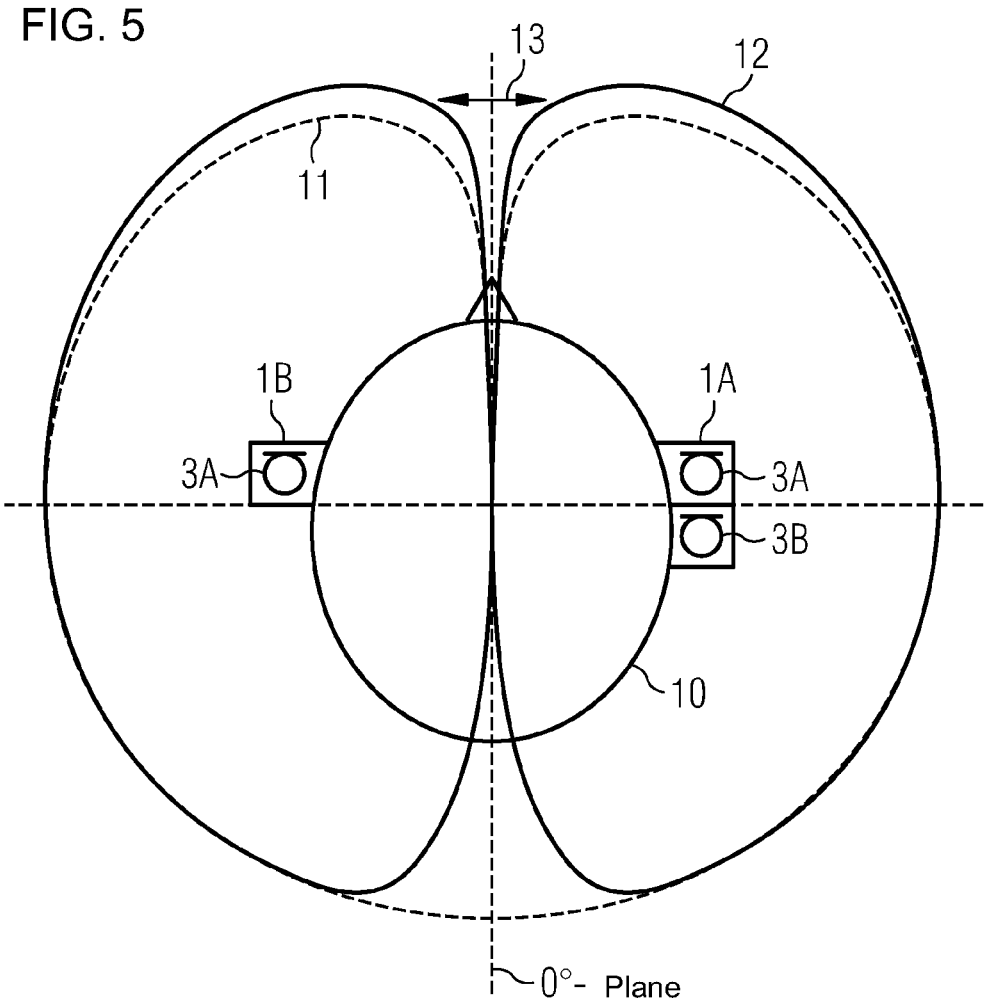
FIG. 5 is an illustration of a microphone arrangement having a monaural anti-cardioid and a binaural figure of eight.

FIG. 5 shows a sectional view through the head 10 of a hearing device wearer with a first hearing device 1A and a second hearing device 1B for binaural provision. The section is taken parallel to a floor surface at the height of the two hearing devices 1A, 1B. The first hearing device 1A contains a first microphone 3A and a second microphone 3B. The second hearing device 1B contains a first microphone 3A.

The first microphone 3A of the first hearing device 1A is connected together wirelessly with first microphone 3A of the second hearing device 1B in order to form a directional microphone having a binaural directional characteristic 12. For example, by performing a simple subtraction on the microphone signals from the two microphones 3A a spatial directional characteristic 12 is produced, which corresponds to a "figure of eight", which lies in the direction of the axis connecting the microphones 3A and ideally exhibits an area 13 with sensitivity zero in the 0° plane.

The two microphones 3A, 3B of the first hearing device 1A are located close to one another and are connected to each other electrically in such a manner that they form a spatial directional characteristic in the shape of an anti-cardioid 11. Around a 0° direction, from which a useful signal comes, the directional characteristic exhibits an area 13 of strong attenuation.

Figure 6:
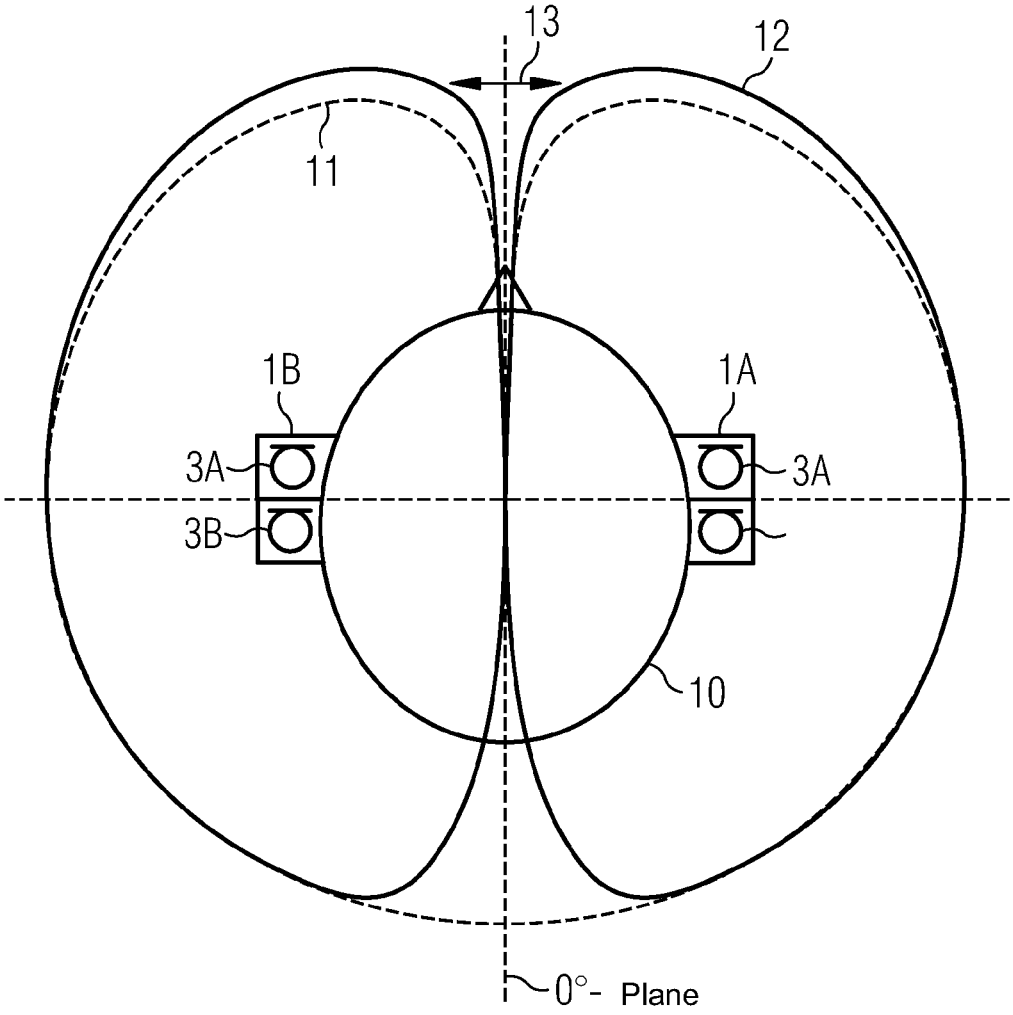
FIG. 6 is an illustration of another microphone arrangement.

FIG. 6 shows a sectional view through the head 10 of a hearing device wearer with a first hearing device 1A and a second hearing device 1B for binaural provision. The section is taken parallel to a floor surface at the height of the two hearing devices 1A, 1B. The first hearing device 1A contains a first microphone 3A and a second microphone 3B. The second hearing device 1B contains a first microphone 3A and a second microphone 3B.

One noise level corresponding to the different directional characteristics 11, 12 is now estimated per frequency band. The results of the two noise estimation methods are reckoned up together with one another by a suitable connection, a maximum or sum formation for example, in such a manner that for those spatial directions in which the one characteristic 11 allows acoustic noise to pass through only inadequately (small angles around 0° with regard to the anti-cardioid 11, 0° plane around the head with regard to the binaural figure of eight 12) the result is compensated for by the ability of the other characteristic 12 in each case to allow acoustic noise to pass through in these directions. This is the case for all directions apart from the strictly limited 0° direction. Only the area 13 around 0°, delimited by the narrow horizontal aperture angle of the binaural figure of eight 12 to the front and the wider aperture angle of the anti-cardioid 11 to the front, remains as the area 13 in which the maximum of the two output signal levels is ideally close to zero. The narrow aperture angle in the horizontal direction ensures an effect heavily dependent on the horizontal line of vision of a hearing device wearer, which approximates to that of a very narrow "beam". The somewhat wider aperture in the vertical direction ensures that a useful signal area is less dependent on a head tilt of the hearing device wearer.

The invention claimed is:

1. An apparatus for background noise estimation, the apparatus comprising:

first and second hearing devices for binaural supply of a hearing impaired person, each of said hearing devices having a first and a second omnidirectional microphone and said first and second microphones of each of said hearing devices connected to each other electrically to form a first and a second directional microphone having a first and a second monaural directional characteristic respectively, one of said first and second microphones of said first hearing device connected together wirelessly with one of said first and second microphones of said second hearing device to form a directional microphone having a binaural directional characteristic, and for estimating background noise, levels of output signals from said first and second directional microphones having the monaural directional characteristic are combined with a level of an output signal from said directional microphone having the binaural directional characteristic;

wherein the binaural directional characteristic and at least one of the first and the second monaural directional characteristic form a zero point in a direction of a useful sound source.

2. The apparatus according to claim 1, wherein at least one of the first and the second monaural directional characteristic forms a monaural anti-cardioid.

3. The apparatus according to claim 1, wherein the binaural directional characteristic forms a binaural figure of eight.

4. The apparatus according to claim 1, wherein the background noise is formed by forming a maxima of the levels of the output signals from the directional microphones.

5. The apparatus according to claim 1, wherein the background noise is formed by forming sums of the levels of the output signals from the directional microphones.

6. An apparatus for background noise estimation, the apparatus comprising:

first and second hearing devices for a binaural supply of a hearing impaired person, said first hearing device having a first omnidirectional microphone and said second hearing device having a first and a second omnidirectional microphone and said first and second omnidirectional microphones of said second hearing device are electrically connected to each other to form a second directional microphone having a monaural directional characteristic, said first microphone of said first hearing device connected together wirelessly with one of said first and second microphones of said second hearing device for forming a directional microphone having a binaural directional characteristic, and for estimating a background noise, a level of an output signal from said second directional microphone having the monaural directional characteristic is combined with a level of an output signal from the directional microphone having the binaural directional characteristic;

wherein the combined binaural directional characteristic and monaural directional characteristic form a zero point in a direction of a useful sound source.

7. The apparatus according to claim 6, wherein the monaural directional characteristic forms a monaural anti-cardioid.

8. The apparatus according to claim 6, wherein the binaural directional characteristic forms a binaural figure of eight.

9. The apparatus according to claim 6, wherein the background noise is formed by forming a maxima of the levels of the output signals from the directional microphones.

10. The apparatus according to claim 6, wherein the background noise is formed by forming sums of the levels of the output signals from the directional microphones.

11. A method for background noise estimation, which comprises the steps of:

providing a first and a second hearing device for a binaural supply of a hearing impaired person, in each case the first and second hearing devices have a first and a second omnidirectional microphone and the first and second microphones of each of the hearing devices are connected to each other electrically for forming a first and a second monaural directional characteristic;

connecting one of the first and second microphones of the first hearing device together wirelessly with one of the first and second microphones of the second hearing device for forming a binaural directional characteristic; and estimating a background noise by combining levels of output signals from the first and the second directional microphone having the monaural directional characteristic with a level of an output signal from the directional microphone having the binaural directional characteristic, the combined binaural directional characteristic and monaural directional characteristic forming a zero point in a direction of a useful sound source.

12. The method according to claim 11, which further comprises forming the background noise by forming a maxima of the levels of the output signals from the directional microphones.

13. The method according to claim 11, which further comprises forming the background noise by forming sums of the levels of the output signals from the directional microphones.

14. A method for background noise estimation, which comprises the steps of:

providing a first and a second hearing device for binaural supply of a hearing impaired person, the first hearing device having a first omnidirectional microphone and the second hearing device having a first and a second omnidirectional microphone and the first and second microphones of the second hearing device are electrically connected to each other for forming a second monaural directional characteristic;

connecting the first microphone of the first hearing device together wirelessly with one of the first and second microphones of the second hearing device for forming a binaural directional characteristic; and estimating a background noise by combining a level of an output signal from the second directional microphone having a monaural directional characteristic with a level of an output signal from the directional microphone having the binaural directional characteristic, the combined binaural directional characteristic and monaural directional characteristic forming a zero point in a direction of a useful sound source.

15. The method according to claim 14, which further comprises forming the background noise by forming a maxima of the levels of the output signals from the directional microphones.

16. The method according to claim 14, which further comprises forming the background noise by forming sums of the levels of the output signals from the directional microphones.

* * * * *